US005378163A

United States Patent [19]

Gladura et al.

[11] Patent Number: 5,378,163

[45] Date of Patent: Jan. 3, 1995

[54] POWER TOOL PLUG SAFETY COVER

[76] Inventors: Joseph Gladura; Jean T. Gladura, both of 2015 Cross Creek Dr., South Bend, Ind. 46628

[21] Appl. No.: 99,516

[22] Filed: Jul. 30, 1993

[51] Int. Cl.[6] ..... H01R 13/44

[52] U.S. Cl. ..... 439/134; 439/464; 439/467

[58] Field of Search ..... 439/134, 135, 149, 148, 439/367, 368, 369, 465, 600, 464, 467

[56] References Cited

U.S. PATENT DOCUMENTS 2,761,112 8/1956 Torcivia ..... 439/135

3,598,900 8/1971 Drake ..... 439/135

4,865,557 9/1989 Kershaw ..... 439/134

*Primary Examiner*—David Pirlot

*Attorney, Agent, or Firm*—E. Michael Combs

[57] ABSTRACT

A cover structure arranged to enclose a power tool plug to discourage access includes first and second housings pivotally mounted relative to first and second anchor straps, wherein the first and second covers each include a respective first and second floor having a respective first and second floor recess when in contiguous communication or a mirror image relationship relative to one another to receive an opening tool within said recess.

4 Claims, 4 Drawing Sheets

POWER TOOL PLUG SAFETY COVER

BACKGROUND OF THE INVENTION

1. Field of the Invention

The field of invention relates to power supply safety structure, and more particularly pertains to a new and improved power tool plug safety cover arranged to limit access relative to a power tool plug limiting access thereto by children and the like.

2. Description of the Prior Art

Cover structure for extension cords and the like is indicated in the prior art and exemplified by the U.S. Pat. Nos. 4,917,626; 4,643,505; and 4,834,664.

The instant invention attempts to overcome deficiencies of the prior art by providing for a convenient retrofit structure arranged for surrounding relationship relative to a power cord plug member and in this respect, the present invention substantially fulfills this need.

SUMMARY OF THE INVENTION

In view of the foregoing disadvantages inherent in the known types of power tool plug safety covers now present in the prior art, the present invention provides a power tool plug safety cover wherein the same includes cooperative pivotal housings mounted relative to one another on opposed sides of the tool plug. As such, the general purpose of the present invention, which will be described subsequently in greater detail, is to provide a new and improved power tool plug safety cover which has all the advantages of the prior art power tool plug safety tool covers and none of the disadvantages.

To attain this, the present invention provides a cover structure arranged to enclose a power tool plug to discourage access, including first and second housings pivotally mounted relative to first and second anchor straps, wherein the first and second covers each include a respective first and second floor having a respective first and second floor recess when in contiugous communication or a mirror image relationship relative to one another to receive an opening tool within said recess.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the forgoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved power tool plug safety cover which has all the advantages of the prior art power tool plug safety covers and none of the disadvantages.

It is another object of the present invention to provide a new and improved power tool plug safety cover which may be easily and efficiently manufactured and marketed.

It is a further object of the present invention to provide a new and improved power tool plug safety cover which is of a durable and reliable construction.

An even further object of the present invention is to provide a new and improved power tool plug safety cover which is susceptible of a low cost of manufacture with regard to both materials and labor, and which accordingly is then susceptible of low prices of sale to the consuming public, thereby making such power tool plug safety covers economically available to the buying public.

Still yet another object of the present inventions to provide a new and improved power tool plug safety cover which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
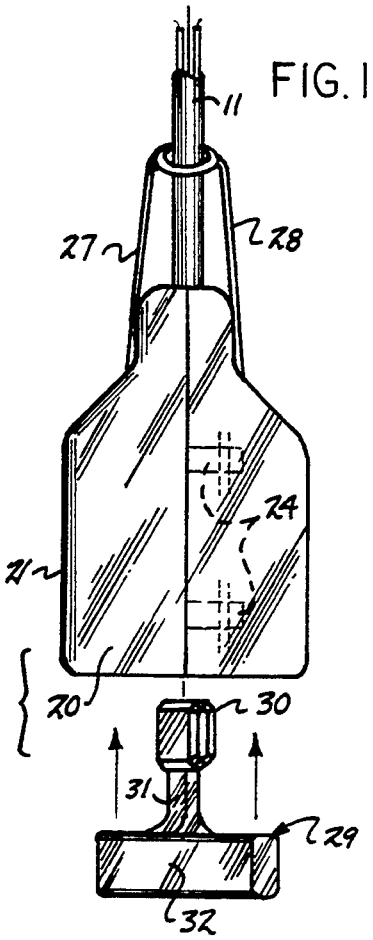
FIG. 1 is an orthographic top view of the invention.
Figure 2:
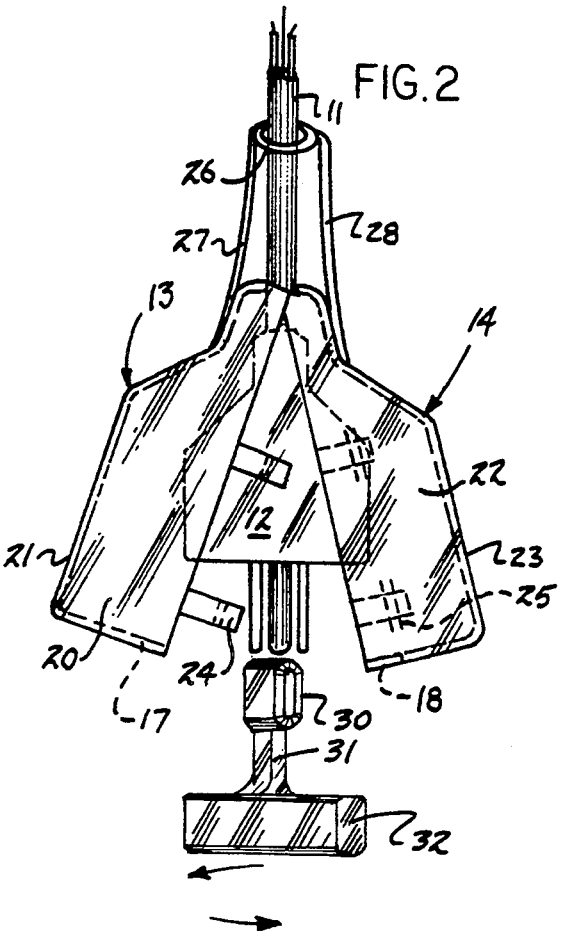
FIG. 2 is an orthographic top view of the invention arranged in an opened orientation subsequent to employment of the opening tool.

With reference now to the drawings, and in particular to FIGS. 1 to 9 thereof, a new and improved power tool plug safety cover embodying the principles and concepts of the present invention and generally designated by the reference numeral 10 will be described.

Figure 3:
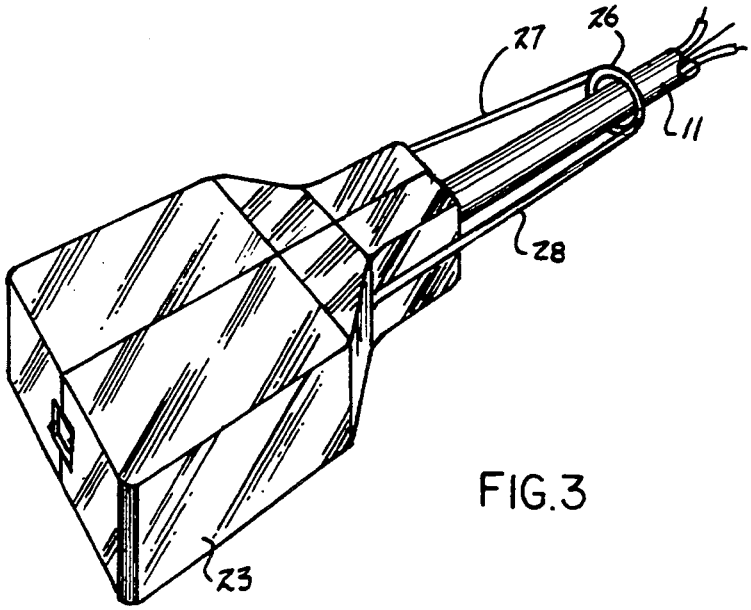
FIG. 3 is an isometric illustration of the invention.
Figure 4:
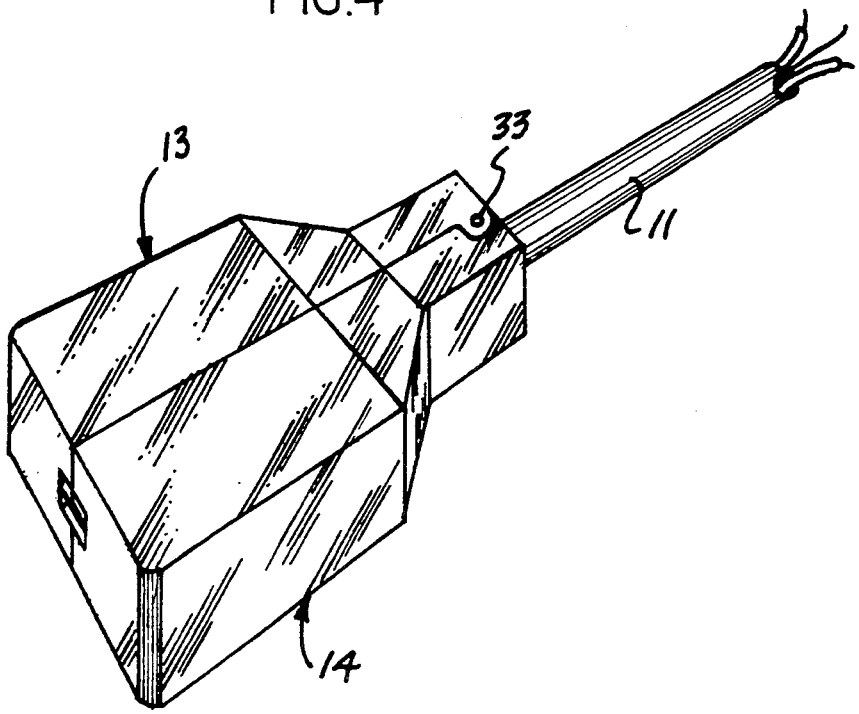
FIG. 4 is an isometric illustration of the invention employing a hinge cover structure.
Figure 5:
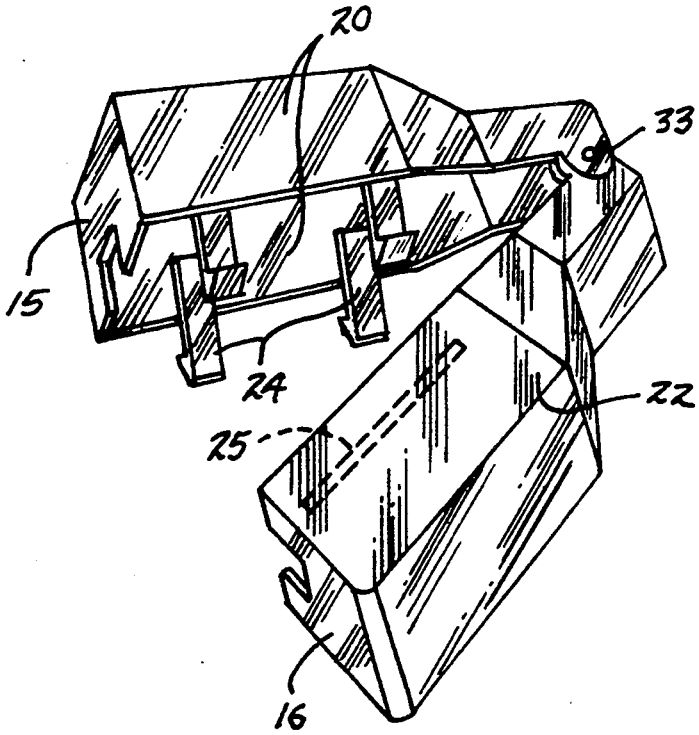
FIG. 5 is an isometric illustration of the invention and the hinge cover structure arranged in an opened orientation.

More specifically, the power tool plug safety cover 10 of the invention is arranged to afford the selective covering of an electrical plug 12 mounted to a free end of an electrical cord 11. The safety cover includes a first cover housing 13 of a complementary construction to a second cover housing 14. The first cover housing having a first cover housing floor 15 arranged in a coplanar orientation to a second cover housing floor 16, with the first and second cover housings in contiguous communication relative to one another, as indicated in FIG. 3 for example. The first floor 15 includes a first recess 17 that cooperates with a second floor recess 18 in a mirror image relationship, such as indicated in FIG. 3, when the first and second cover housings are in contiguous communication and locked relative to one another, such that a rectilinear end wall opening 19 is thereby defined arranged to receive an opening tool 29 having a rectilinear head 30 received within the end wall opening 19, whereupon rotation of the head 30 by a handle 32 interconnected to the head by a shank 31, the first and second cover housing floors 15 and 16 respectively are separated. The first cover housing have first housing side walls 20 in a parallel relationship and are arranged coplanar relative to second housing side walls 22. The first housing including first housing end wall 21, with second housing having a second housing end wall 23. Latch legs 24 project from the first housing side walls 20 and are arranged for engaging ribs 25 mounted within the second housing to the second housing side walls 22, such that each of the latch legs 24 are of a generally L-shaped configuration to engage in associated rib structure.

An anchor loop 26 is positioned adjacent the first and second cover housing top wall, with the first and second cover housing top walls receiving the electrical cord 11 therethrough, with the anchor loop 26 spaced from the first and second dover housing tip walls receiving the electrical cord therethrough. A first flexible anchor strap 27 is directed from the anchor loop 26 to the first cover housing side wall 20, with a second flexible anchor strap 28 diametrically spaced from the first anchor strap relative to the anchor loop 26, having the second anchor strap 28 mounted to the second housing side wall 22 permitting ease of pivoting of the first and second cover housings relative to one another relative to the electrical cord 11, as well as maintaining alignment of the cover housings diametrically opposed relative to one another by the loop and strap structure 26 or 28. Alternatively, a hinge 33 (see FIG. 5) may be employed to pivotally secure the first housing cover 13 to the second housing cover 14.

Figure 6:
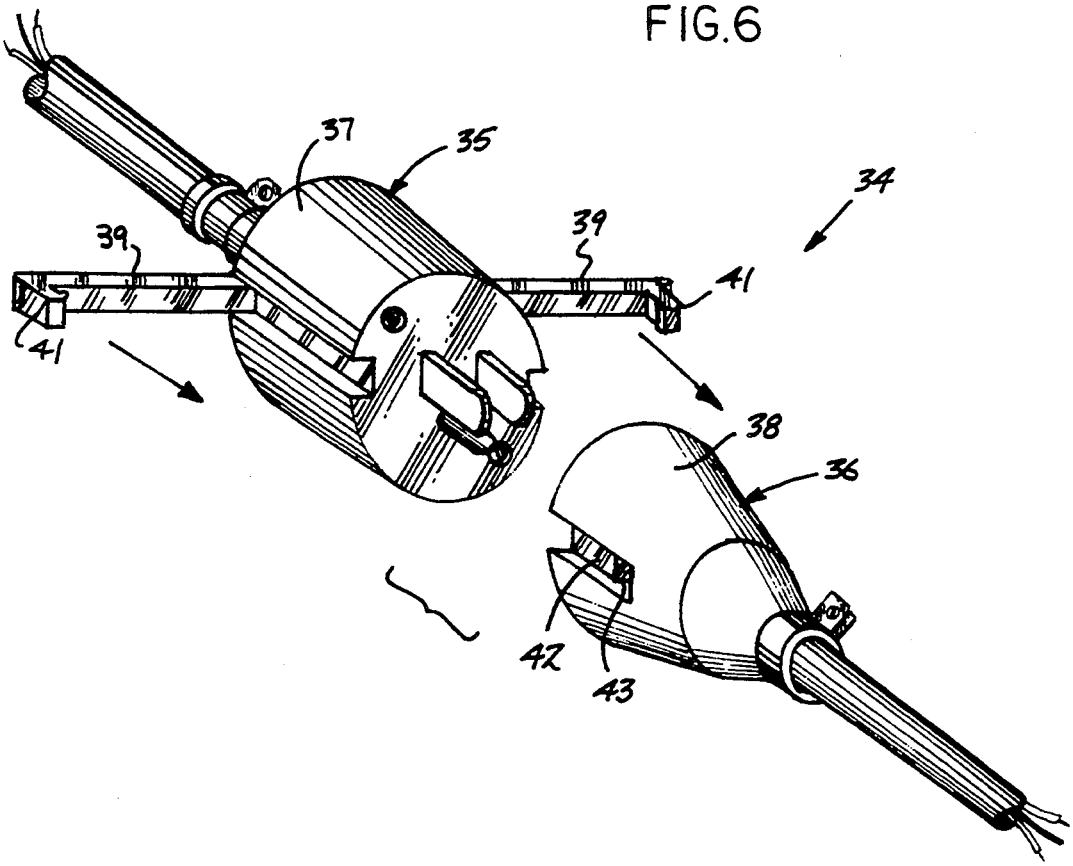
FIG. 6 is an isometric illustration of a cooperating plug and socket connecting assembly.
Figure 7:
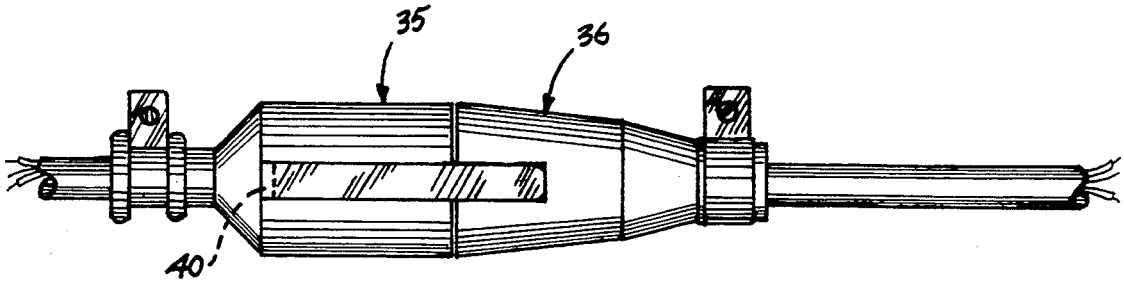
FIG. 7 is an orthographic side view of the connecting assembly.
Figure 8:
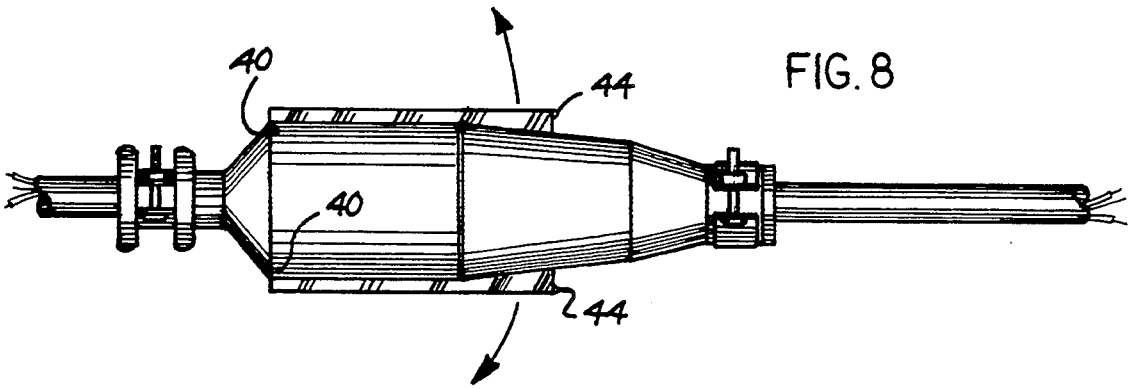
FIG. 8 is an orthographic top view of the connecting assembly.
Figure 9:
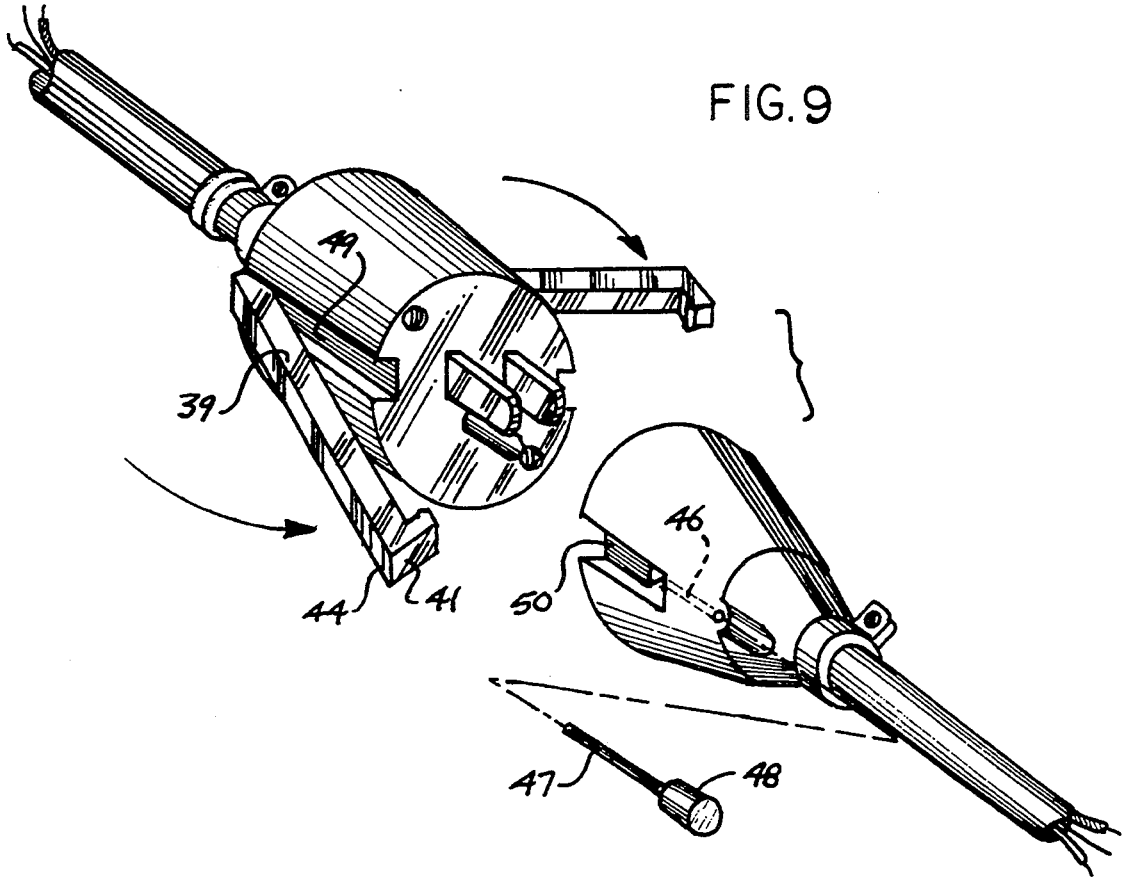
FIG. 9 is an isometric illustration of the connecting assembly including a separation tool.

The FIG. 6 indicates the use of a connector assembly 34 to secure a plug member 35 to a socket member 36. The plug member 35 having a plug member side wall 37, the socket member having a socket member side wall 38. Lock legs 39 are pivotally mounted diametrically opposed relative to one another about a respective pivot axle 40 to the plug member side wall 37. Each of the lock legs 39 includes a lock leg tang 41. A plurality of first slots 42 are directed into the socket member side wall 38, each having a tang receiving cavity 43 to receive the lock leg tang 41, with the plug member side walls 37 having first and second slots 45. Projecting lugs 44 are mounted to the intersection of each tang to each lock leg 39 to permit ease of manual separation of the lock leg structure relative to the socket members. A bore 46 is directed through the socket member aligned with the first slot floor and the second slot floor 50 when the plug and socket members are secured relative to one another to effect separation of the lock legs relative to the socket member by directing the release pin 47 along the floors 49 and 50. The release pin 47 includes a release pin handle 48 for ease of manual manipulation of the release pin structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the Unites Sates is as follows:

1. A power tool plug safety cover, comprising in combination with an electrical cord, the electrical cord including an electrical cord plug, and a first cover housing and a second cover housing, the first cover housing including a first cover housing floor, the second cover housing including a second cover housing floor, the first cover housing including a first cover housing top wall, the second cover housing including a second cover housing top wall, and the first cover housing including first side walls, the second cover housing having second side walls, the first housing including a first housing end wall, and the second housing including a second housing end wall, and a power cord directed through an intersection of said first housing top wall and said second housing top wall, with the first housing floor spaced from the first housing top wall and the second housing floor spaced from the second housing top wall, with the first cover housing and the second cover housing arranged in contiguous communication relative to one another in a first position and arranged in a separated orientation relative to one another in a second position, and, lock means mounted within the first cover housing, and a plurality of ribs mounted within the second cover housing, wherein the lock means are arranged for securement to the ribs, an anchor loop, the anchor loop receiving the electrical cord therethrough, and the anchor loop spaced from the first cover housing top wall and the second cover housing top wall, and a first flexible anchor strap extending from said anchor loop to said first cover housing end wall, and a second flexible anchor strap diametrically displaced relative to said first anchor strap, with the second anchor strap extending from the anchor loop to the second housing end wall.

2. A safety cover as set forth in claim 1 wherein the electrical plug is mounted within the first cover housing and the second cover housing.

3. A safety cover as set forth in claim 2 wherein the lock means includes at least one L-shaped latch leg mounted to each first cover housing side wall, with each second cover housing side wall having one of said ribs.

4. A safety cover as set forth in claim 3 wherein the first cover housing floor and the second cover housing floor are coplanar relative to one another in the first position, and the first cover housing floor having a first recess, the second cover housing floor having a second recess, wherein the first recess and the second recess are arranged in coextensive contiguous communication relative to one another in the first position defining a rectilinear end wall opening, and an opening tool, the opening tool having a rectilinear head received within said end wall opening, the end wall head having a support shank and a handle mounted to the support shank spaced from the head, whereupon rotation of the head effects displacement of the first cover housing floor relative to the second cover housing floor.

* * * * *